US006578535B2

(12) United States Patent
Spath et al.

(10) Patent No.: US 6,578,535 B2
(45) Date of Patent: Jun. 17, 2003

(54) VALVE-DEACTIVATING LIFTER

(75) Inventors: Mark J. Spath, Spencerport, NY (US); Albert C. Stone, Grandville, MI (US); Carl R. Kangas, Sand Lake, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/229,350

(22) Filed: Aug. 26, 2002

(65) Prior Publication Data

US 2002/0195072 A1 Dec. 26, 2002

Related U.S. Application Data

(63) Continuation-in-part of application No. 09/840,375, filed on Apr. 23, 2001, now Pat. No. 6,497,207, which is a continuation-in-part of application No. 09/693,452, filed on Oct. 20, 2000, now Pat. No. 6,513,470, which is a continuation-in-part of application No. 09/607,071, filed on Jun. 29, 2000, now abandoned.

(60) Provisional application No. 60/141,985, filed on Jul. 1, 1999.

(51) Int. Cl.[7] ..... F01L 1/34

(52) U.S. Cl. ..... 123/90.16; 123/90.15; 123/90.5; 123/90.52; 123/90.55

(58) Field of Search ..... 123/90.16, 90.15, 123/90.39, 90.48, 90.5, 90.52, 90.55, 90.61, 90.63, 198 F

(56) References Cited

U.S. PATENT DOCUMENTS 5,090,364 A * 2/1992 McCarroll et al. ..... 123/90.16
5,255,639 A * 10/1993 Shirey et al. ..... 123/90.16
5,655,487 A * 8/1997 Maas et al. ..... 123/90.16
5,709,180 A * 1/1998 Spath ..... 123/90.16
5,893,344 A * 4/1999 Church ..... 123/90.16
5,934,232 A * 8/1999 Greene et al. ..... 123/90.16
6,092,497 A * 7/2000 Preston et al. ..... 123/90.16
6,196,175 B1 * 3/2001 Church ..... 123/90.16
6,273,039 B1 * 8/2001 Church ..... 123/90.16
6,321,704 B1 * 11/2001 Church et al. ..... 123/90.16
6,321,705 B1 * 11/2001 Fernandez et al. ..... 123/90.16
6,325,030 B1 * 12/2001 Spath et al. ..... 123/90.16

* cited by examiner

*Primary Examiner*—Teresa Walberg
*Assistant Examiner*—Fadi H. Dahbour
(74) *Attorney, Agent, or Firm*—Patrick M. Griffin

(57) ABSTRACT

A valve-deactivation hydraulic valve lifter including a conventional hydraulic lash adjuster means disposed within a pin housing slidably disposed in a lifter body. A transverse bore in the pin housing contains opposed locking pins for selectively engaging a circumferential groove including a locking surface in the lifter body whereby the lifter body and the pin housing may be engaged or disengaged to activate or deactivate a pushrod controlling an engine valve. Ends of the locking pins are spherical so that the pins cannot become stuck in corners in the groove. The groove corner is rounded be either a positive radius or a negative radius to remove a sharp corner known to be an originating and propagating point for stress failure of the lifter body in prior art lifters. The edge of each pin and the edge of the locking surface are chamfered to prevent damage to these edges during locking and unlocking. A second surface intermediate an outer surface of the pin housing and the transverse bore is also provided. A retaining ring holding the lifter assembly together may be augmented by a spacer whose thickness is selected to yield a predetermined amount of mechanical lash in the deactivation lifter.

19 Claims, 5 Drawing Sheets

VALVE-DEACTIVATING LIFTER

CROSS-REFERENCE TO RELATED APPLICATION

This application is a continuation-in-part of U.S. patent application Ser. No. 09/840,375, filed Apr. 23, 2001, now U.S. Pat. No. 6,497,207, which is a continuation-in-part of U.S. patent application Ser. No. 09/693,452, filed Oct. 20, 2000, now U.S. Pat. No. 6,513,470, which is a continuation-in-part of U.S. patent application Ser. No. 09/607,071, filed Jun. 29, 2000, now abandoned which claims the benefit of U.S. Provisional Patent Application Serial No. 60/141,985, filed Jul. 1, 1999.

TECHNICAL FIELD

The present invention relates to lifters for activating valves in response to rotation of a camshaft in an internal combustion engine; more particularly, to such lifters having means for selectively engaging and disengaging such activation; and most particularly, to a valve lifter wherein operational reliability is substantially increased through improved features of various components and wherein a means for lash adjustment is provided.

BACKGROUND OF THE INVENTION

It is well known that overall fuel efficiency in a multiple-cylinder internal combustion engine can be increased by selective deactivation of one or more of the engine cylinders by the deactivation of intake and exhaust valves, under certain engine load conditions. A known approach to providing selective valve deactivation in a push rod engine is to equip the lifters for those valves with means whereby the lifters may be rendered incapable of transferring the cyclic motion of engine cams into reciprocal motion of the associated pushrods and valves. Typically, a deactivation lifter in a push rod engine includes concentric inner and outer portions which are mechanically responsive to the pushrod and to the cam lobe, respectively, and which may be selectively latched and unlatched to each other, typically by controlling the position of a locking member within the lifter by the selective application or removal of pressurized engine oil to the locking pins. The lifter may also include a conventional hydraulic lash compensation means as known in the art.

U.S. Pat. No. 6,164,255, issued Dec. 26, 2000 to Maas et al., discloses a deactivation hydraulic valve lifter comprising an outer section which encloses an inner section that is axially movable relative therein, the outer section having a pot-shaped configuration and a bottom which comprises an end for cam contact and separates the inner section from a cam whereby, upon coupling of the sections by a coupling means, a high lift of a gas exchange valve is effected, and upon uncoupling of the sections, a zero lift. The disclosed coupling means is a single round pin disposed in a transverse bore in the inner section and biased outwards by a coil spring to engage a mating bore in the outer section, whereby the two sections may be locked together. The bore in the outer section is matable with an oil gallery in the engine block, whereby pressurized oil may be introduced against the head of the locking pin to urge the pin hydraulically into retraction within the inner section to uncouple the inner and outer sections and thereby deactivate the associated engine valve.

In order for the locking pin to engage reliably into the outer section bore, the bore must be somewhat oversize to accommodate rotational and axial alignment tolerances.

However, this can result in high contact stress between the pin and the bore, and also some sliding movement as the pin moves into contact at the lowest point in the bore, both of which can result in undesirably high wear rates leading to noisy actuation and possible failure of the lifter. Further, the asymmetric nature of the load path in a single locking pin design such as that disclosed in Mass et al., can result in operational stiffness of the lifter deactivation mechanism, accelerated wear, and unpredictable leak down of the hydraulic element due to tipping of the inner body from the asymmetric loading.

U.S. Pat. No. 6,321,704 B1, issued Nov. 27, 2001 to Church et al., the relevant disclosure of which is herein incorporated by reference, discloses a mechanism purportedly useful in a valve-deactivating hydraulic lash adjuster or a valve deactivating hydraulic lifter. The mechanism is similar to that disclosed by Maas et al. but includes a pair of opposed locking pins disposed in a transverse bore in the inner section to engage the outer section in two separate locations 180° apart. Further, the outer section single bore of Maas et al. is replaced by an annular groove formed in the inner wall of the outer section and defining an annular locking surface such that all rotational alignment requirements are removed, the pins being engageable into the groove at all rotational positions of the inner section within the outer section. The groove communicates, similarly to the bore in Maas et al., with an oil gallery in the engine block for actuation and deactivation of the locking pins. Further, the pins are flattened in the portion which engages the locking surface to distribute the load over a broad area of the locking surface. Also, the outer ends of the pins are cylindrically shaped, where the radius of the cylindrically shaped ends matches the inside radius of the annular groove that is formed in the inner wall of the outer section.

A deactivation hydraulic valve lifter in accordance with Church et al. can be vulnerable to reliability problems. First, the sharp 90° inner corner of groove 69, as shown in FIGS. 3 and 4, focuses stress on the latching surface in the groove and can lead to stress failure of the outer body member 17 at that point, particularly when, during erratic pin engagement, a single pin carries the majority of the load for one or more engine revolutions. Further, the entrance edge or corner of latching surface 71 is vulnerable to damage or distress by the lower corner of latching member 63 during repeated latching and unlatching as the member corner is released by the entrance corner of the latching surface, which distress can cause the latching member (locking pin) either to jam in the locked position or to refuse to engage into the locked position. Also, the metal around the circumferential edge of the transverse bore is vulnerable to stress or distortion from repeated loading of the locking pins. Such metal distortion can impart shearing forces across the entrance edge of the annular groove when the pin housing slides within the axial bore of the lifter body.

In addition, the Church et al. patent fails to disclose a means for adjusting mechanical lash in the deactivation mechanism caused from inherent manufacturing variability in the deactivation components. The entire assembly is held together by a standard stop clip 39 which is full-fitting in a groove in outer body member 17, as shown in FIG. 3. Thus, the amount of lash between latching member 63 and latching surface 71 after assembly cannot be compensated or adjusted in individual lifter assemblies.

It is a principal object of the present invention to provide an improved valve-deactivation hydraulic lifter wherein reliability is increased by reconfiguring locking components to reduce distress and thereby reduce sticking susceptibility between the locking pins and the locking groove.

It is a further object of the invention to provide such a lifter wherein mechanical lash in the deactivation mechanism can be readily adjusted during assembly of the lifter.

SUMMARY OF THE INVENTION

Briefly described, a valve-deactivation valve lifter in accordance with the invention includes a pin housing that is slidably disposed within an axial bore in a lifter body. A transverse bore in the pin housing contains two opposed locking pins urged outwards of the pin housing by a pin spring disposed in compression therebetween to engage a circumferential groove including a locking surface in the lifter body whereby the lifter body and the pin housing are locked together for mutual actuation by rotary motion of the cam lobe to produce reciprocal motion of an engine pushrod. The pins may be disengaged from the lifter body by application of hydraulic fluid such as engine oil through one or more fluid ports to the outer ends of the pins at pressure sufficient to over come the force of the pin spring.

The outer most ends of the locking pins are generally spherical and their leading edges chamfered such that the pins cannot block nor enter the fluid ports and the leading edges cannot contact a conjunctive corner within the circumferential groove wherein the radial wall of the groove meets the axial locking surface of the groove. Further, the entrance edge of the locking surface is also chamfered to prevent mutual abuse and distress at the leading edge of the pin and entrance edge of the groove during locking and unlocking, which distress is known to cause sticking of pins in prior art lifters. In addition, the conjunctive corner of the groove is rounded by a radius such that a sharp corner is obviated, which sharp corner is known to be an originating and propagating point for stress failure of the lifter body in prior art lifters. A relief is also provided on the pin housing circumscribing the ends of the transverse pin bore to reduce metal distress around the outside edges of the bore and to prevent any deformation of the pin housing's cylindrical surface at the edges of the bore from shearing across the entrance edge of the circumferential groove in the lifter body. Further, the snap ring holding the lifter assembly together also functions to set the mechanical lash in the deactivation mechanism. The latch adjusting feature may be provided as a one-part ring of a selected thickness or as a two-part ring, the first part being a standard-thickness ring and the second part being a shim whose thickness is selected to provide a predetermined amount of lash therein.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
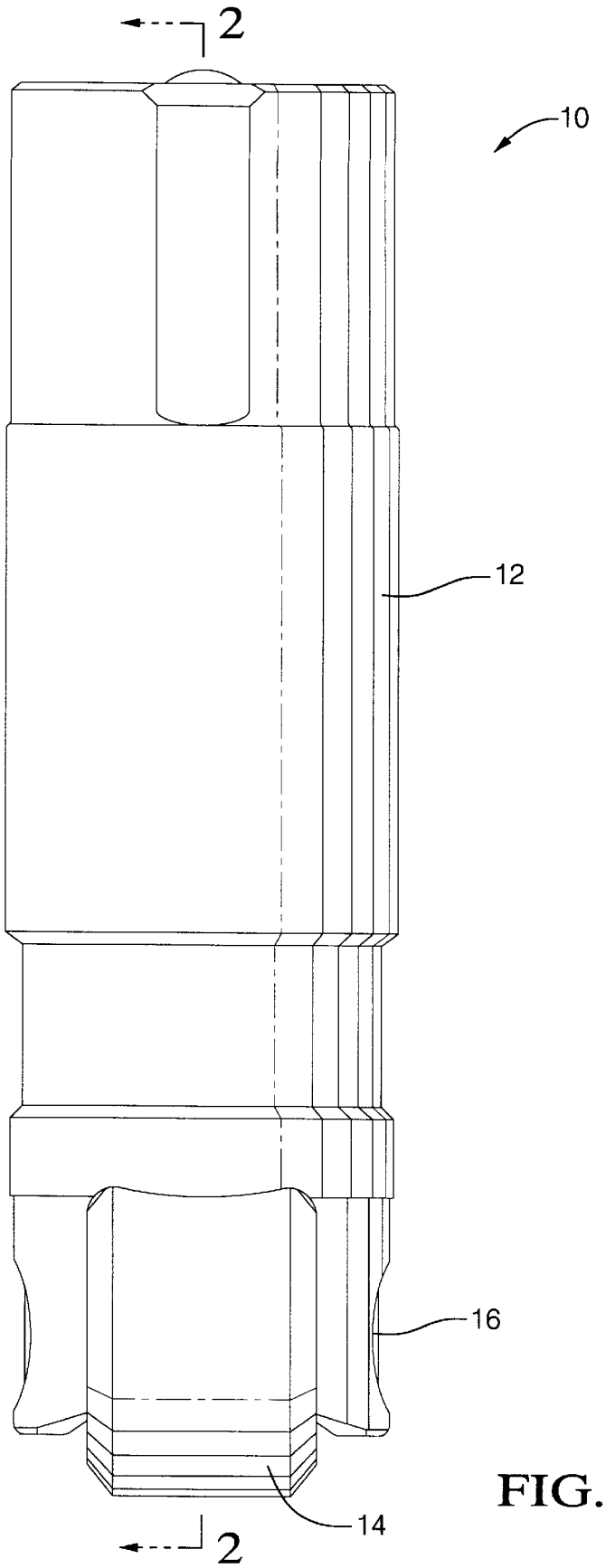
FIG. 1 is an elevational view of a valve-deactivating hydraulic lifter in accordance with the invention.
Figure 2:
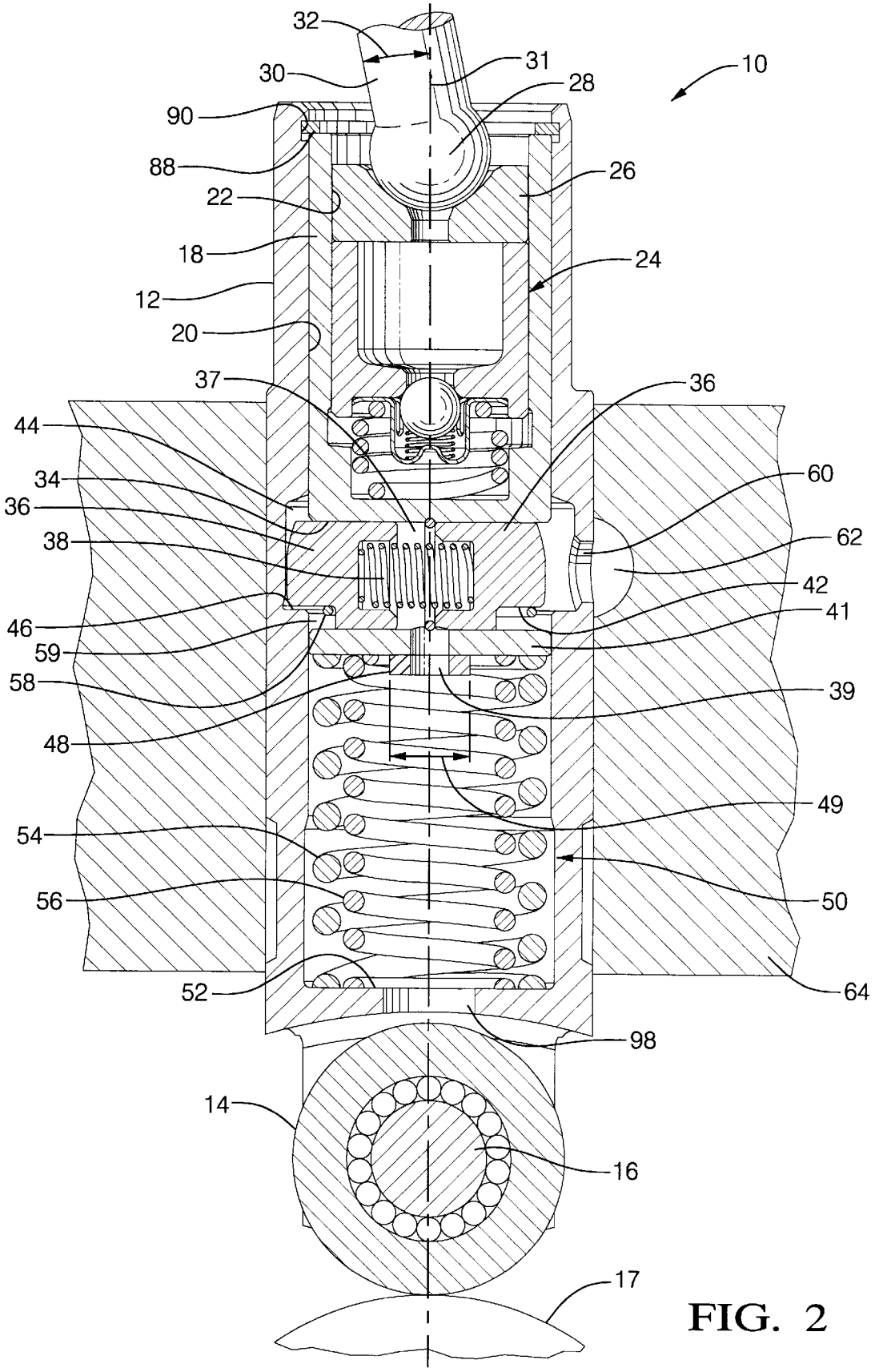
FIG. 2 is an elevational cross-sectional view taken along line 2—2 in FIG. 1, the lifter being disposed for operation in an engine block between a cam lobe and a pushrod.

Referring to FIG. 1, a valve-deactivating hydraulic valve lifter 10 in accordance with the invention has a generally cylindrical lifter body 12 supporting conventionally at a lower end a cam follower means such as roller 14 rotatably attached to body 12 by an axle 16 for following a cam lobe 17 (FIG. 2).

Referring to FIG. 2, a pin housing 18 is slidably disposed within a first axial bore 20 in lifter body 12. Pin housing 18 itself may have a second axial bore 22 for receiving a conventional hydraulic lash adjuster (HLA) mechanism generally designated 24 which may be of a type well known to those skilled in the art. The HLA is not an essential feature of the invention, and will not be described further herein. HLA 24 includes a pushrod seat 26 for receiving a ball end 28 of a conventional engine valve pushrod 30. Lifter 10 is especially useful in accommodating engine designs wherein the pushrod is not coaxially disposed with lifter axis 31 but rather forms an included angle 32 therewith.

Figure 3:
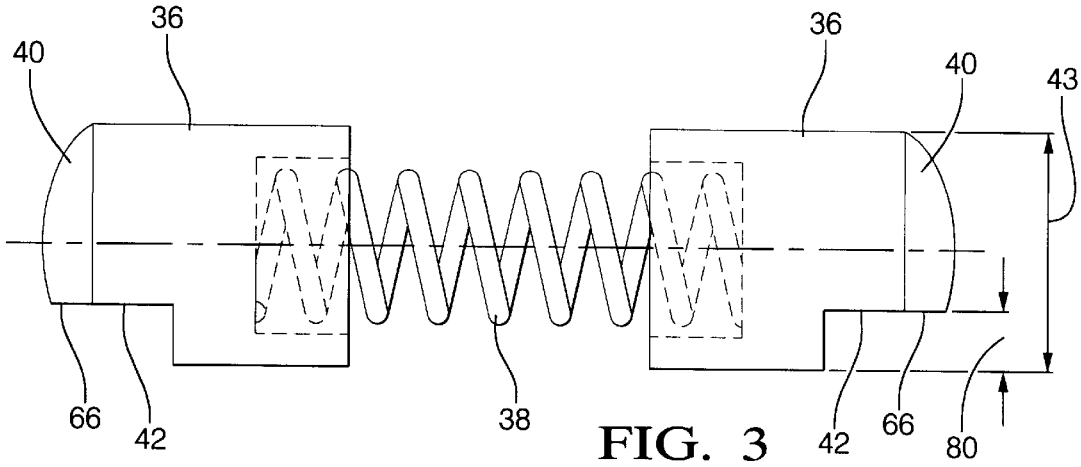
FIG. 3 is a perspective view of deactivation pins and spring of FIG. 2.

Pin housing 18 has a transverse bore 34 slidably receivable of two opposed locking pins 36 separated by a pin spring 38 disposed in compression therebetween in a cavity 37 vented via port 39. Referring to FIG. 3, each of pins 36 includes at one end thereof pin faces 40. The pin faces are substantially spherical in shape. Each of pins 36 also includes stepped flats 42.

Inner wall 21 (FIG. 5) of first axial bore 20 in lifter body 12 is provided with a circumferential groove 44 for receiving the outer ends of locking pins 36, thrust outwards by spring 38 when pins 36 are axially aligned with groove 44. Groove 44 includes an axial surface 46 defining a locking surface for receiving stepped flats 42 of pins 36.

Bottom end 41 of pin housing 18 defines a seat for a lost motion return spring means 50 disposed within bore 20 between end 41 and end 52 of bore 20. Preferably, spring means 50 comprises two springs, a first coil spring 54 having a greater spring force and a second coil spring 56 disposed within first spring 54 and having a lesser spring force. Preferably, the two springs are counter-wound to prevent meshing of the coils. The use of two springs instead of a single spring having the same combined force permits use of a shorter spring cavity and reduction in the overall length of the lifter assembly. Bottom end 41 of pin housing 18 also defines raised pad 48 having an outer diameter 49 of approximately 4.0 mm. The center axis of pad 48 in generally concentric with lifter center axis 31. Raised pad 48 is used to accurately measure the position of pin housing 18 inside lifter body 12 for setting lash, as will be described in more detail below.

Circumferential groove 44 further defines a reservoir for providing high pressure oil against pin faces 40 of locking pins 36 to overcome pin spring 38 and retract the locking pins into bore 34, thereby unlocking the pin housing from the lifter body to deactivate the lifter. Groove 44 is in communication via at least one port 60 with an oil gallery 62 in engine 64, which in turn is supplied with high pressure oil by an engine control module (not shown) under predetermined engine parameters in which deactivation of valves is desired. Port 60 has a diameter that is less than diameter 43 of locking pins 36.

Pin housing 18 further includes anti-rotation ring 58, which is disposed within circumferential groove 59 of pin housing 18 adjacent locking pins 36. Anti-rotation ring 58 is disposed in close proximity to stepped flats 42, and thus rotation of pins 36 is substantially limited by the ring. Anti-rotation ring 58 is generally C-shaped. The gap in C-shaped ring 58 is oriented away from pins 36 to avoid undesirable rotation of one of pins 36. Preferably, once oriented, ring 58 is held in place by a narrowed portion of groove 59 or by upsetting a portion of groove 59 after ring 58 is installed.

Figure 5:
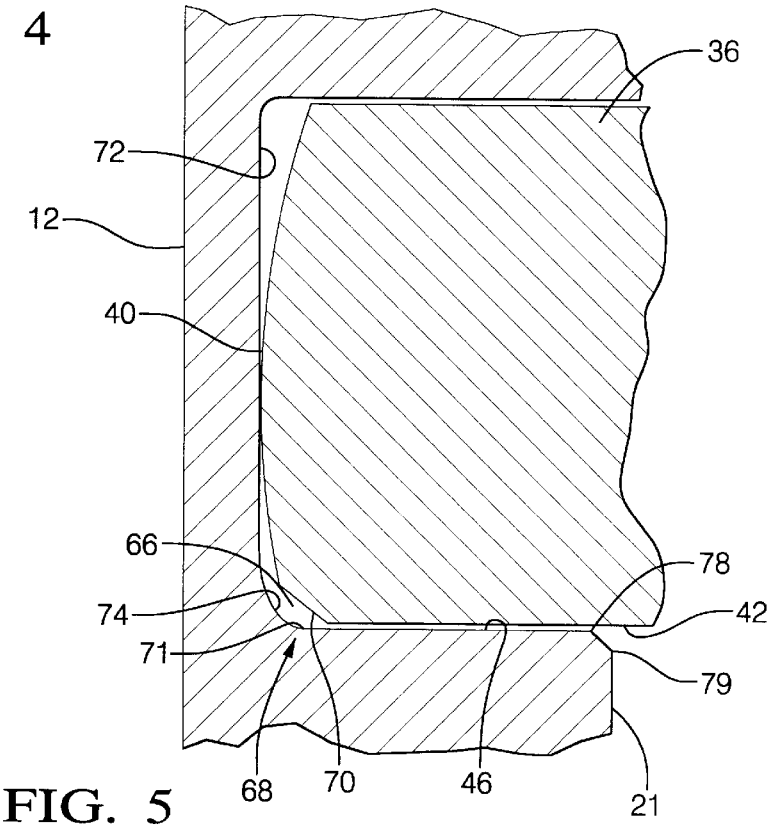
FIG. 5 is a detailed elevational cross-sectional view of a first embodiment of a locking groove and locking pin in accordance with the invention.
Figure 6:
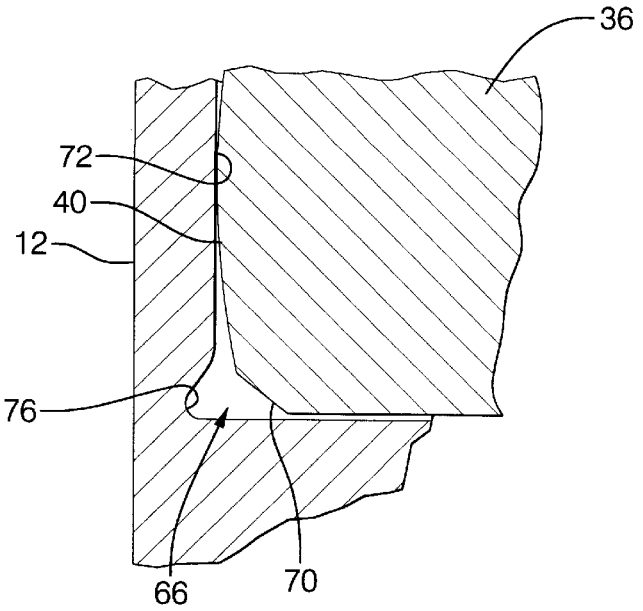
FIG. 6 is a detailed elevational cross-sectional view of a second embodiment of a locking groove and locking pin.

Referring to FIGS. 5 and 6, it is a feature of the invention that the load-bearing leading edge 66 of each locking pin 36 be prevented from engaging a conjunctive corner 68 of locking groove 44, as this is known in some prior art lifters to eventually result in sticking or wear or metal distress. Therefore, leading pin edge 66 is relieved, such as with uniform chamfer 70, and the pin face is spherical in shape such that conjunctive corner 68 is inaccessible to the locking pins.

It is yet another feature of the invention that conjunctive corner 68 of circumferential groove 44 be formed as other than a sharp 90° included angle at the conjunction of radial wall 72 and axial locking surface 46 of groove 44, as is known to be a factor in stress failure of some prior art lifter bodies. Therefore, as shown in FIG. 5, conjunctive corner 68 may be filled with a "positive" radius 74, or a "recessed" radius 76, as shown in FIG. 6 as a "heel-shaped" cavity, to reduce stress concentration imposed on corner 68.

During the transitions between locking and unlocking, leading pin edge 66 passes abruptly over entrance edge 78 (FIG. 5) of locking surface 46, causing significant and undesirable abuse and distress of both corners in some prior art lifters, especially when the locking pin deactivation oil pressure is low. It is yet another feature of the invention that leading pin edge 66 (as described above) and entrance edge 78 are both chamfered or radiused (70,79), as shown for example in FIG. 5, such that no sharp or delicate edges are present to become distressed.

Figure 4:
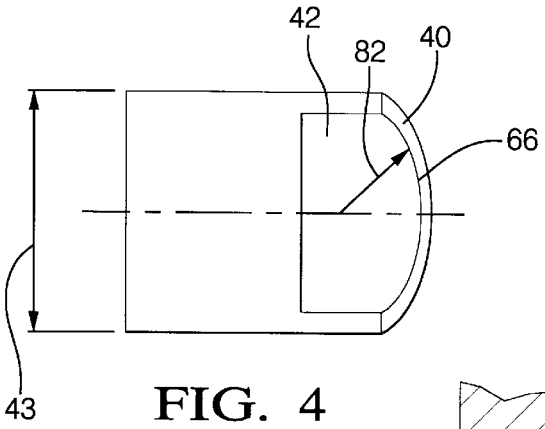
FIG. 4 is a bottom view of one of the deactivation pins shown in FIG. 3.

As shown in FIG. 3, pin faces 40 are substantially spherical in shape. It is still another feature of this invention that the spherical radius of faces 40 be greater that the radius of radial wall 72 of groove 44. The larger spherical radius of pin faces 40, relative to the radius of radial wall 72 results in pin faces 40 being flatter than the radial wall radius. Thus, only the outer edges of pin faces 40 can come in contact with the radial wall when pins 36 are fully extended. Pins 36 are thereby prevented from extending into and/or closely engaging and blocking port 60. Additionally, referring to FIGS. 3 and 4, the depth 80 of stepped flats 42 is selected so that radius 82 defined by leading pin edge 66 is substantially equal to the radius of axial bore 20 so that the initial pin to groove engagement is maximized when leading pin edge 66 first engages entrance edge 78 of groove 44.

Figure 7:
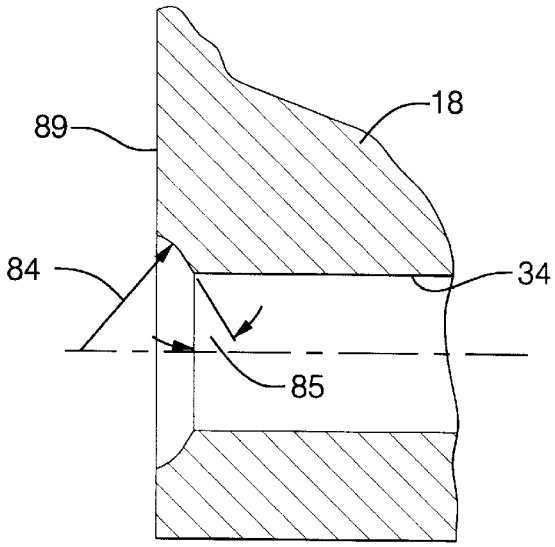
FIG. 7 is a detailed elevational cross-sectional view of the entry to a transverse pin bore in a pin housing, showing a preferred second surface intermediate an outer surface of the pin housing and the pin bore.
Figure 8:
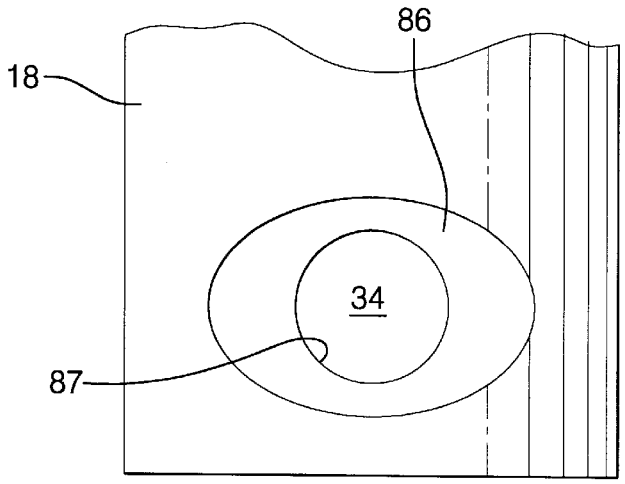
FIG. 8 is a side view of the pin housing, showing the transverse locking pin bore and the detail of the second surface circumscribing the bore.

In operation, the entrances to pin bore 34 in pin housing 18 are also known to be damaged by the shearing action between the pin housing and body bore and pin forces exerted on the pin housing of some prior art lifters. Therefore, referring to FIGS. 7 and 8, it is yet another feature of the invention that each entry to pin bore 34 is preferably relieved by application of, for example, a cylindrical cutter having radius 84 transversely of the axis of pin bore 34, which creates a second surface 86 that circumscribes the bore and is located intermediate outer surface 89 of pin housing 18 and transverse bore 34. The size of cutter radius 84 is selected to provide a generally acute angle 85, as shown in FIG. 7, to provide distress relief around openings 87 of pin bore 34 and to prevent metal deformation around the openings that otherwise could interfere with movement of pin housing 18 within first axial bore 20 of lifter body 12.

Figure 9:
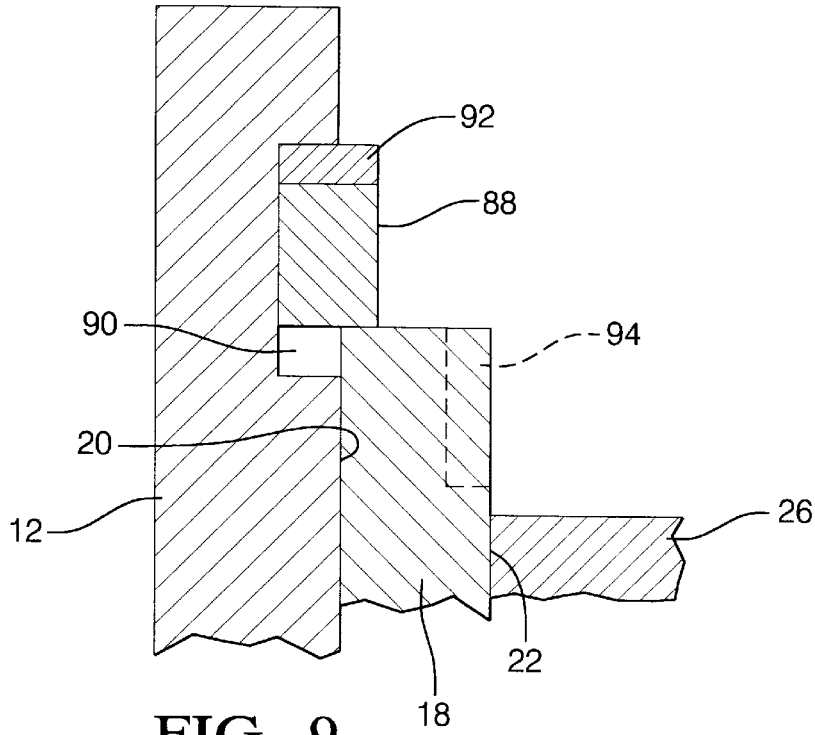
FIG. 9 is a detailed elevational cross-sectional view of a lash-adjusting arrangement in accordance with the invention.

It is an additional feature in accordance with the invention that mechanical lash in the deactivation mechanism can be measured and adjusted after assembly of the lifter. Such lash is defined as the clearance between groove locking surface 46 and pin step flat 42 (FIG. 5) when the lifter is assembled and the pins are therefore in locking position. Sufficient clearance is needed to permit the pins to lock and unlock easily and reliably, but additional clearance creates clatter and accelerated wear in operation of the lifter. Because of inherent variability in lifter components as manufactured, undesirable variations in lash will occur without the labor intensive matching of assembly components. In a lifter in accordance with the invention, groove 90 is formed having an excessive length in the axial direction toward the cam follower, as shown in FIG. 9. After assembly of any one lifter using a standard ring 88 having a thickness intended to yield excessive mechanical lash between the locking surface and locking pin, the resulting lash can be measured directly, and a spacer 92 of a thickness selected to provide optimum lash may be subsequently installed adjacent to ring 88.

A method for setting lash comprises the steps of:

a) installing pin housing 18 into first axial bore 20 in lifter body 12;

b) engaging locking pins 36 with locking surface 46;

c) installing retaining ring 88 into groove 90;

d) biasing pin housing 18 against retaining ring 88;

e) measuring a clearance between stepped flats 42 on locking pins 36 and locking surface 46 (this can be done by measuring the total axial travel of pin housing 18 from the biased position of step d, after subjecting the pin housing to an axial force equal to a known pushrod load);

f) numerically subtracting a predetermined desired clearance from said measured clearance of step e to obtain a numerical difference;

g) selecting a spacer 92, which can be in the shape of a shim or of retainer ring 88, having a thickness equal to the numerical difference; and h) installing spacer 92 in groove 90 either above or below retaining ring 88 to yield the predetermined desired clearance between locking pins 36 and locking surface 46.

Figure 10:
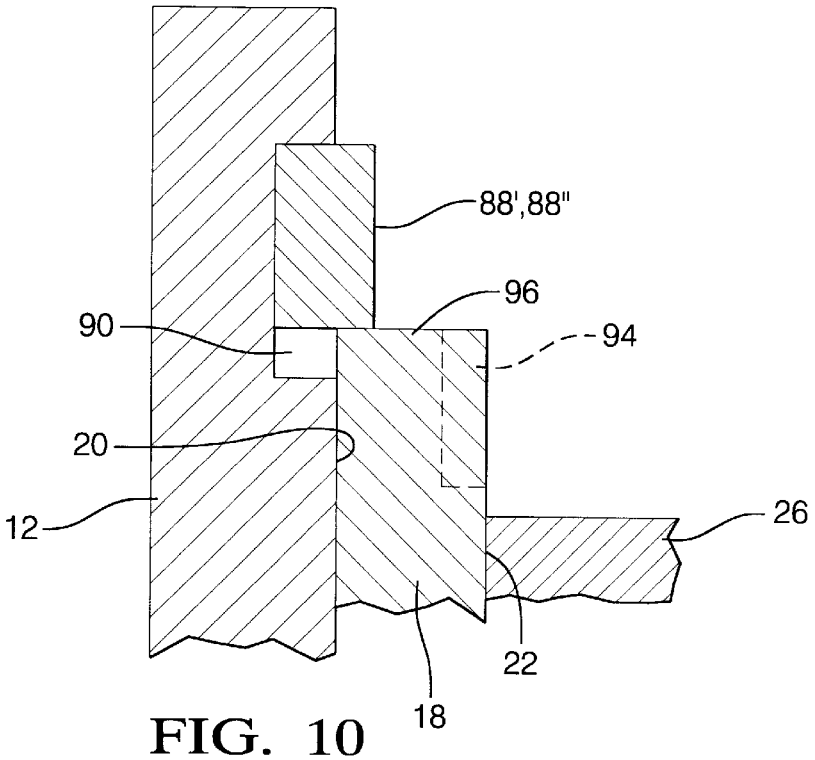
FIG. 10 is a detailed elevational cross-sectional view of a lash-adjusting arrangement of an alternate embodiment in accordance with the invention.

It is understood that, alternatively, a surrogate locator ring 88' can be used to simulate a ring thickness in steps c and d, instead of installing an actual retaining ring 88. Then, after performing the measuring and calculating steps of e and f, a single retainer/spacer ring 88" as shown in FIG. 10 can be selected and installed in steps g and h in place of the surrogate ring.

Because the pin housing is free to rotate within the lifter body during use, it is still another feature of this invention to be able to confirm that the lash is within tolerance at all angular orientations of the pin housing with respect to the lifter body. Preferably, a means is provided for grasping and turning housing 18 in lifter body 12, for example, a slot 94 (FIGS. 9 and 10) formed in the upper rim surface 96 of bore housing 22 which may be accessed through retainer ring 88 and spacer 92. Also, a means is provided for accurately measuring the axial position of pin housing 18 in body 12 whereby an elongate probe having a diameter of approximately 6.0 mm is inserted through oil drain orifice 98 (FIG. 2), preferably before roller 14 is installed, and placed in contact with raised lash adjustment pad 48. Measurements are then made of the axial position of the pin housing when groove locking surface 46 is in contact with pin stepped flat 42 and when lost motion springs 54,56 biases pin housing 18 against ring 88,88' in the opposite direction. Since the measuring probe can only make contact via the raised pad with the pin housing close to the pin housing's axial center, measurement errors introduced by the tipping of the pin housing inside the body are significantly reduced.

Ring 88, disposed in groove 90 also serves to retain the lost-motion springs 54,56 and pin housing 18 in lifter body 12. Referring to FIG. 2, it is a further feature of the invention that ring 88 extends further inwardly, at least for a portion of its inner diameter, into second bore 22 by a radial distance sufficient to also retain pushrod seat 26 in pin housing 18 but insufficient to interfere with pushrod 30.

The present invention is herein described and illustrated in connection with a valve-deactivating hydraulic valve lifter for use with a pushrod type valve train, but the invention could also be utilized in, for example, a valve-deactivating hydraulic lash adjuster for use with an end-pivot rocker arm.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A valve-deactivating lifter for selectively coupling the rotary motion of a cam lobe to the reciprocal motion of a valve pushrod in an internal combustion engine, comprising:

a) a lifter body having means for following an eccentric surface of said cam lobe and having a first axial bore and having a circumferential groove including a radial wall and an axial locking surface formed in an inner wall of said first axial bore and having a chamfered edge of said axial locking surface at said inner wall of said first axial bore, said groove being in communication with an oil gallery in said engine, and said radial wall and said axial locking surface forming a conjunctive corner;

b) a pin housing slidably disposed in said first axial bore and having a transverse bore therethrough and having a second axial bore;

c) a means disposed in said second axial bore for receiving an end of said pushrod; and d) a pair of opposed locking pins slidably disposed in said transverse bore on opposite ends of a compressed spring and each having an outer end for selectively engaging said axial locking surface to lock said pin housing to said lifter body, each of said outer ends being generally spherically shaped and having a chamfer on an edge that engages said chamfered edge of said locking surface during locking and unlocking, each of said locking pins having a stepped flat for engagement with said axial locking surface of said circumferential groove.

2. A lifter in accordance with claim 1 wherein said means for receiving an end of said pushrod is a hydraulic lash adjuster.

3. A lifter in accordance with claim 1 further comprising means for retaining said pin housing in said first axial bore.

4. A lifter in accordance with claim 3 further comprising means for setting mechanical lash in said lifter to a predetermined value.

5. A lifter in accordance with claim 4 wherein said means for retaining comprises:

a) a second circumferential groove formed in said inner wall of said first axial bore; and b) a retaining ring disposed in said second groove and extending radially inwards of said inner wall.

6. A lifter in accordance with claim 5 wherein said means for setting mechanical lash includes a spacer disposed in said second groove adjacent said retaining ring.

7. A lifter in accordance with claim 1 wherein a second surface intermediate an outer surface of said pin housing and said transverse bore circumscribes an opening of said transverse bore.

8. A lifter in accordance with claim 1 wherein said axial locking surface is planar, said radial wall of said circumferential groove is arcuate, and said planar locking surface and said arcuate radial wall define said conjunctive corner.

9. A lifter in accordance with claim 1 wherein said conjunctive corner includes a positive radius portion.

10. A lifter in accordance with claim 1 wherein said conjunctive corner includes a recessed radius portion.

11. A lifter in accordance with claim 1 wherein the radius of each spherical shaped pin end is larger than the radius of said radial wall of said circumferential groove.

12. A lifter in accordance with claim 11 wherein said edge of each locking pin has a radius in the plan of the stepped flat and said edge radius is substantially equal to the radius of said first axial bore.

13. A lifter in accordance with claim 1 wherein said pin housing includes a means for turning said housing in said lifter body.

14. A lifter body in accordance with claim 13 wherein said means for turning is a slot formed in an upper rim of said pin housing.

15. A lifter body in accordance with claim 1 wherein said pin housing includes a bottom end and said bottom end defines a raised pad having a center axis concentric with a center axis of said second axial bore of said pin housing.

16. A method for setting the mechanical lash to a predetermined desired value in a valve-deactivating lifter having a pin housing disposed in a lifter body wherein the housing is retained in the body by a retaining ring disposed in a retainer groove in the lifter body and extends radially inwards of an inner wall of said body, the pin housing having locking pins slidably disposed in a transverse bore for engaging a circumferential groove in the lifter body, said circumferential groove having a locking surface, comprising the steps of:

a) installing said pin housing into said lifter body;

b) engaging said locking pins with said circumferential groove;

c) installing said retaining ring into said retainer groove;

d) biasing said pin housing against said retaining ring;

e) measuring a clearance between said locking pins and said locking surface;

f) numerically subtracting a predetermined desired clearance value from said measured clearance to obtain a first numerical difference;

g) selecting a spacer having a thickness equal to said first numerical difference; and h) installing said selected spacer in said retainer groove adjacent said retaining ring to yield said predetermined desired clearance (lash) in said lifter.

17. A method in accordance with claim 16 wherein the pin housing includes a means for turning said housing in said lifter body and step h) is replaced with the steps of:

h) installing a tool in said means, and turning said housing in said lifter body a number of degrees less than 360 degrees;

i) measuring a clearance between said locking pins and said locking surface;

j) numerically subtracting a predetermined desired clearance value from said measured clearances to obtain a second numerical difference;

k) selecting a spacer having a thickness according to said first and second numerical differences; and l) installing said selected spacer in said retainer groove adjacent said retaining ring to yield said predetermined desired clearance (lash) in said lifter.

18. A method for setting the mechanical lash to a predetermined desired value in a valve-deactivating lifter having a pin housing disposed in a lifter body, wherein the housing is retained in the body by a retaining ring disposed in a retainer groove in the lifter body and extends radially inwards of an inner wall of said body, the pin housing having locking pins slidably disposed in a transverse bore for engaging a circumferential groove in the lifter body, said circumferential groove having a locking surface, comprising the steps of:

a) installing said pin housing into said lifter body;

b) engaging said locking pins with said circumferential groove;

c) installing a locator ring of a known thickness into said retainer groove;

d) biasing said pin housing against said locator ring;

e) measuring a clearance between said locking pins and said locking surface;

f) numerically subtracting a predetermined desired clearance value from said measured clearance to obtain a first numerical difference;

g) selecting a retaining ring having a thickness equal to the sum of the known thickness of said locator ring and said numerical difference;

h) removing said locator ring; and i) installing said selected retaining ring in said retainer groove to yield said predetermined desired clearance (lash) in said lifter, whereby said housing is retainer in said body by said retaining ring.

19. A method in accordance with claim 18 wherein the pin housing includes a means for turning said housing in said lifter body and step i) is replaced with the steps of:

i) installing a tool in said means, and turning said housing in said lifter body a number of degrees less than 360 degrees;

j) measuring a clearance between said locking pins and said locking surface;

k) numerically subtracting a predetermined desired clearance value from said measured clearances to obtain a second numerical difference;

l) selecting a retaining ring having a thickness according to the sum of the known thickness of the locator ring and said first and second numerical differences;

m) removing said locator ring; and n) installing said selected retaining ring in said retainer groove to yield said predetermined desired clearance (lash) in said lifter, whereby said housing is retainer in said body by said retaining ring.

* * * * *

Adverse Decision in Interference

Patent No. 6,578,535, Mark J. Spath, Albert C. Stone and Carl R. Kangas, VALVE-DEACTIVATING LIFTER, Interference No. 105,468, final judgment adverse to the patentees rendered May 1, 2008, as to claim 16.

(*Official Gazette September 9, 2008*)